US005924684A

United States Patent [19]

Cheng

[11] Patent Number: 5,924,684

[45] Date of Patent: Jul. 20, 1999

[54] WORKTABLE

[76] Inventor: Wen-He Cheng, P.O. Box 82-144, Taipei, Taiwan

[21] Appl. No.: 08/954,870

[22] Filed: Oct. 21, 1997

[51] Int. Cl.[6] ..... B25B 1/02

[52] U.S. Cl. ..... 269/139; 269/901; 269/220

[58] Field of Search ..... 269/139, 901, 269/220, 136, 219

[56] References Cited

U.S. PATENT DOCUMENTS 4,061,323 12/1977 Beekenkamp ..... 269/220
4,252,304 2/1981 Pettican ..... 269/220
4,527,786 7/1985 Hsu ..... 269/901
4,909,491 3/1990 Cheng ..... 269/220
5,065,989 11/1991 Ho ..... 269/901

*Primary Examiner*—David A. Scherbel
*Assistant Examiner*—Lee Wilson
*Attorney, Agent, or Firm*—A & J

[57] ABSTRACT

A worktable generally includes a pair of leg frames pivotally joined by a joint member, a pair of receiving frames pivotally mounted on the joint member, a pair of first fixtures each slidably mounted on each of the receiving frames, and a pair of second fixtures each slidably mounted on each of the receiving frames and drivingly connected with a lead screw fitted within each of the receiving frames, whereby distance between the two fixtures can be rapidly and easily adjusted as required.

7 Claims, 6 Drawing Sheets

WORKTABLE

CROSS-REFERENCE

This application is related to U.S. Pat. No. 5,065,989, owned by the same inventor.

BACKGROUND OF THE INVENTION

It has been found that the conventional worktable utilizes a lead screw to adjust the distance between two fixtures. However, it is necessary to rotate a hand wheel for 100 turns in order to move a fixture for a distance of 20 cm if the pitch of the lead screw is 2 mm thereby requiring a lot of time in adjustment and therefore, causing much inconvenience in operation. Furthermore, the lead screw must be relatively long in order to join the two fixtures, with the result in increasing the cost of the worktable.

Therefore, it is an object of the present invention to provide a worktable which can obviate and mitigate the above-mentioned drawbacks.

SUMMARY OF THE INVENTION

This invention is related to an improved worktable.

It is the primary object of the present invention to provide a worktable the fixtures of which can be rapidly adjusted.

It is another object of the present invention to provide a worktable which can be easily operated.

It is still another object of the present invention to provide a worktable which is The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
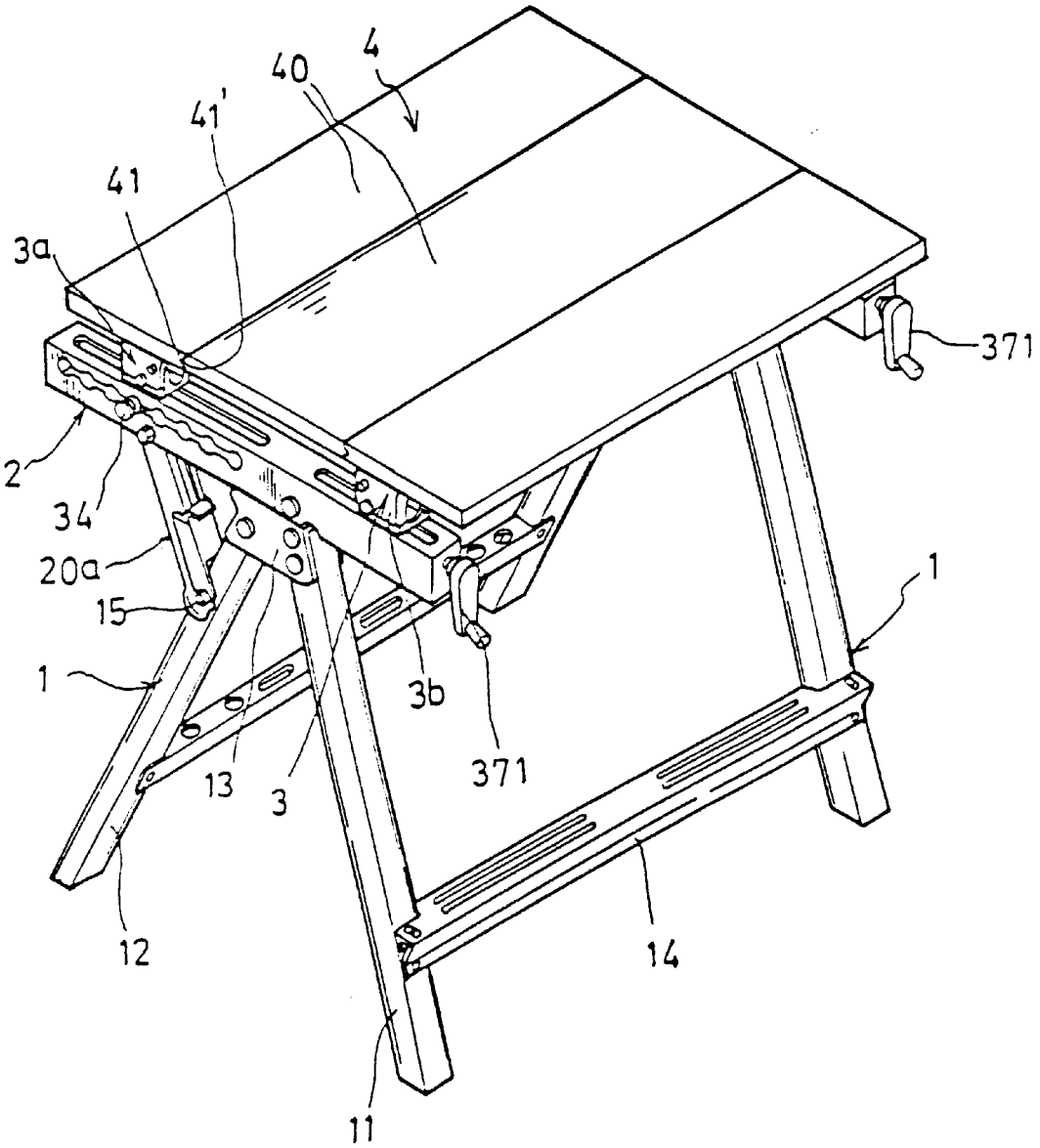
FIG. 1 is a perspective view of a worktable according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
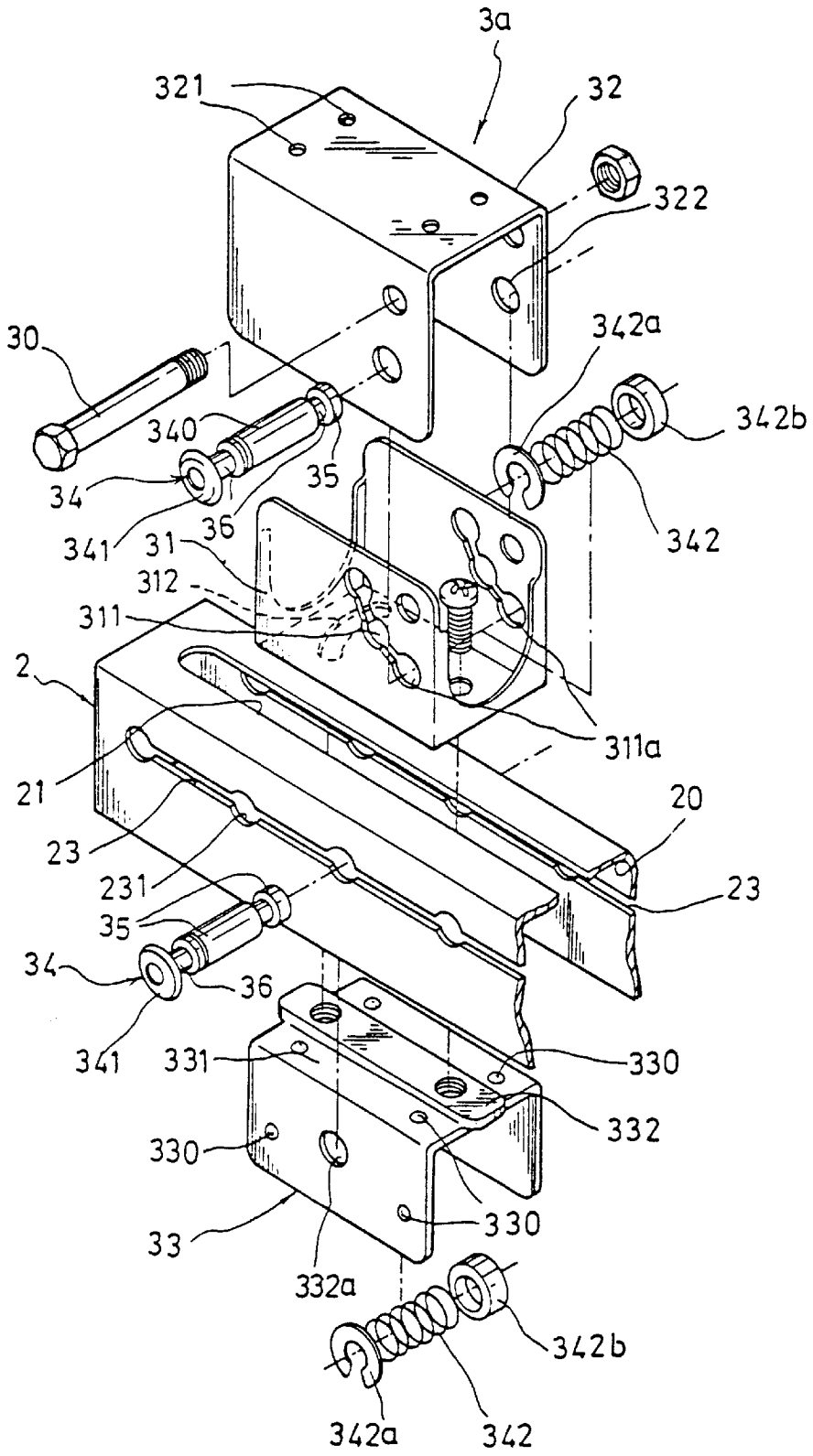
FIG. 2 is an exploded view of a portion of the worktable.
Figure 3:
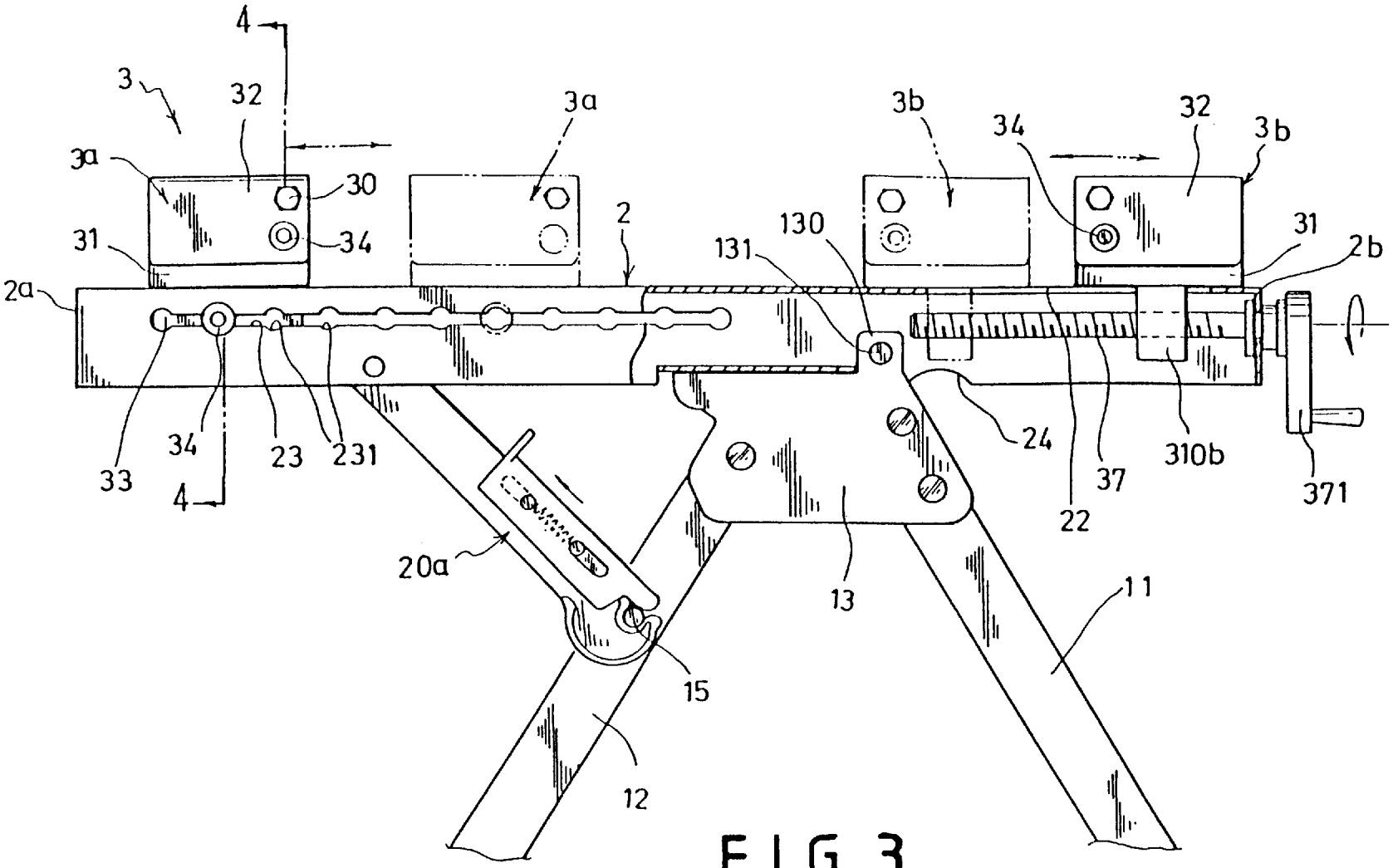
FIG. 3 is a front elevational view of the worktable.

With reference to the drawings and in particular to FIGS. 1, 2 and 3 thereof, the worktable according to the present invention generally comprises a pair of leg frames 1, a pair of receiving frames 2, a pair of first and second fixtures 3*a* and 3*b*, and a tabletop 4.

Each of the leg frames 1 includes two legs 11 and 12 pivotally joined by a joint member 13. Between the two legs 11 there is transversely mounted a tool rack 14 which as openings for receiving tools (not shown) so that they can be accessed easily whenever they are needed. Similarly, a tool rack (shown but not numbered) is transversly installed between the two legs 12.

The receiving frames 2 are pivotally mounted on the joint member 13. A support arm 20*a* is pivotally connected to each of the receiving frames 2 at an end and engageably connected to a pin 15 on the leg 12. The receiving frame 2 is an elongated member having an inverted U-shaped cross section which is formed with a first longitudinal slot 21 at the top of the left portion 2*a* (see FIGS. 2 and 3), a second longitudinal slot 22 at the top of the right portion 2*b* (see FIG. 3), and two longitudinal slots 23 at two opposite lateral sides each having a plurality of spaced apart enlarged holes 231.

Each of the first and second fixtures 3*a* and 3*b* includes a lower seat 31, an upper seat 32. The lower seat 31 is a U-shaped member having a curved slot 312 at the bottom and having two slots 311 at two opposite lateral sides each having a plurality of spaced apart enlarged holes. The upper seat 32 is a U-shaped member which is pivotally connected with the lower seat 31 by a pin 30. A positioning pin 34 extends through the holes 322 at two opposite lateral sides of the upper seat 32 and the slots 311 of the lower seat 31. The top of the upper seat 32 has a plurality of holes 321 for fastening the tabletop 4 thereon. An inverted U-shaped member 33 is arranged within the interior 20 of the receiving frame 2 and has a top 331 formed with a raised portion 332 fitted into the longitudinal slot 21 of the receiving frame 2. A screw 388 extends downwardly through the bottom of the lower seat 31 to engage with a threaded hole on the raised portion 332 of the inverted U-shaped member 33.

The second fixture 3*b* has the same structure as the first slide 3*a*, except that the former is provided with a block 310*b* at the bottom extending downwardly through the second longitudinal slot 22 of the receiving frame 2. A lead screw 37 extends into the receiving frame 2 to threadedly engage with the block 310*b* of the second fixture 3*b* and has an end extending out of the receiving frame 2 to engage with a hand wheel 371, so that the position of the second fixture 3*b* can be easily adjusted by turning the hand wheel 371.

The positioning pin 34 includes a rod member 340, a spring 342 fitted over the rod member 340, a C-shaped retainer 342*a*, and a packing ring 342*b*. The rod member 340 is formed with two necks 36 at the front and rear ends, a button 341 at the front end having a diameter larger than the enlarged hole 231 of the slot 23 of the receiving frame 2 and the enlarged hole 311*a* of the slot 311*a* of the lower seat 31, and a stopper 35 at the rear end.

Figure 7:
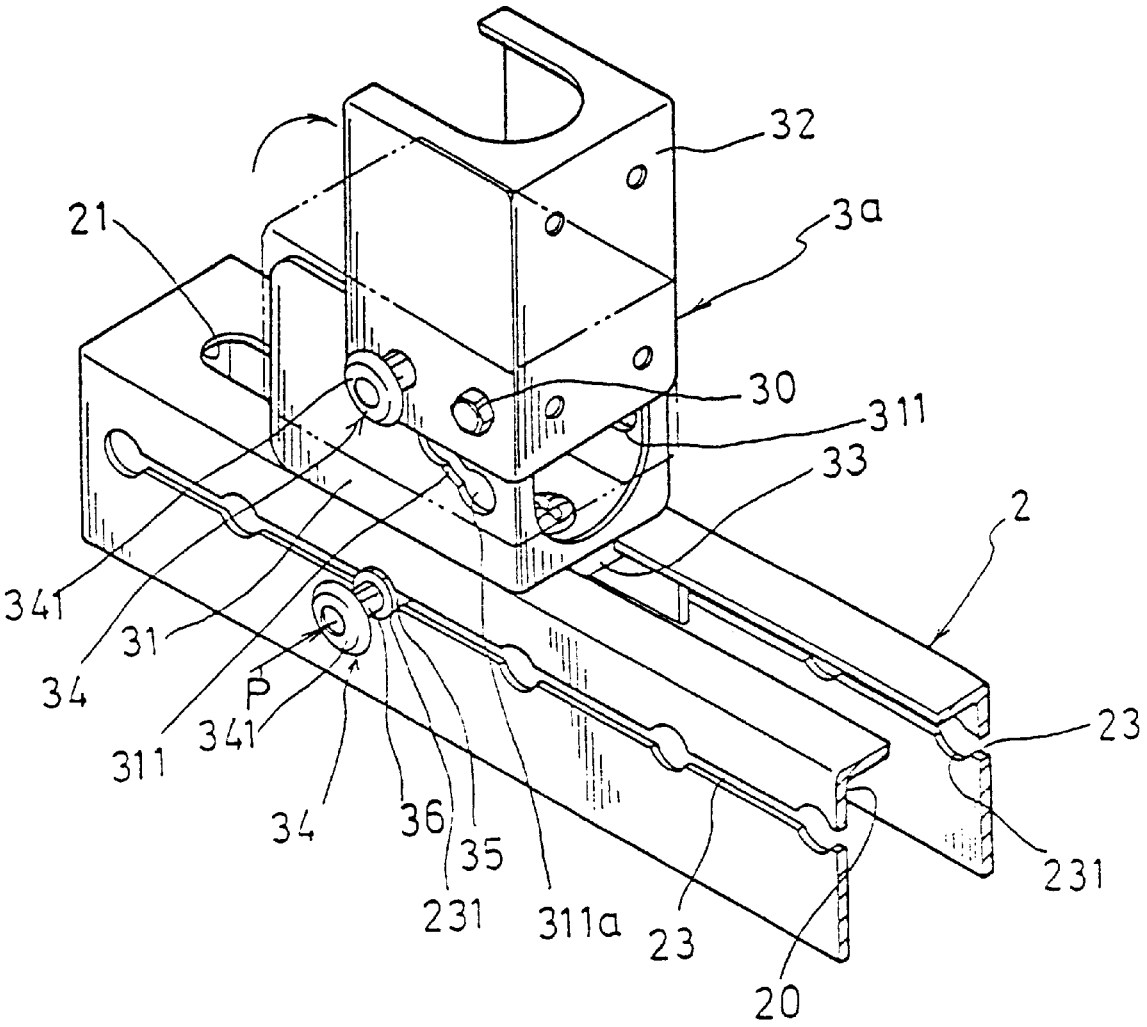
FIG. 7 illustrates how to turn the upper seat with respect to the lower seat.

A first positioning pin 34 is inserted through the holes 322 of the upper seat 32 and the slots 311 of the lower seat 31. The spring 342 is fitted over the rod member 340 and kept thereover by the C-shaped retainer 342*a* engaged with an end of the rod member 340 within the receiving frame 2 and the packing ring 342*b* mounted on another end of the rod member 340 within the receiving frame 2, so that the rod member 340 is resiliently arranged between the upper seat 32 and the lower seat 31. Hence, when the positioning pin 34 is depressed, the upper seat 32 will be released from the lower seat 31 thereby enabling the upper seat 32 to be rotated with respect to the lower seat 31 (see FIG. 7).

Figure 4:
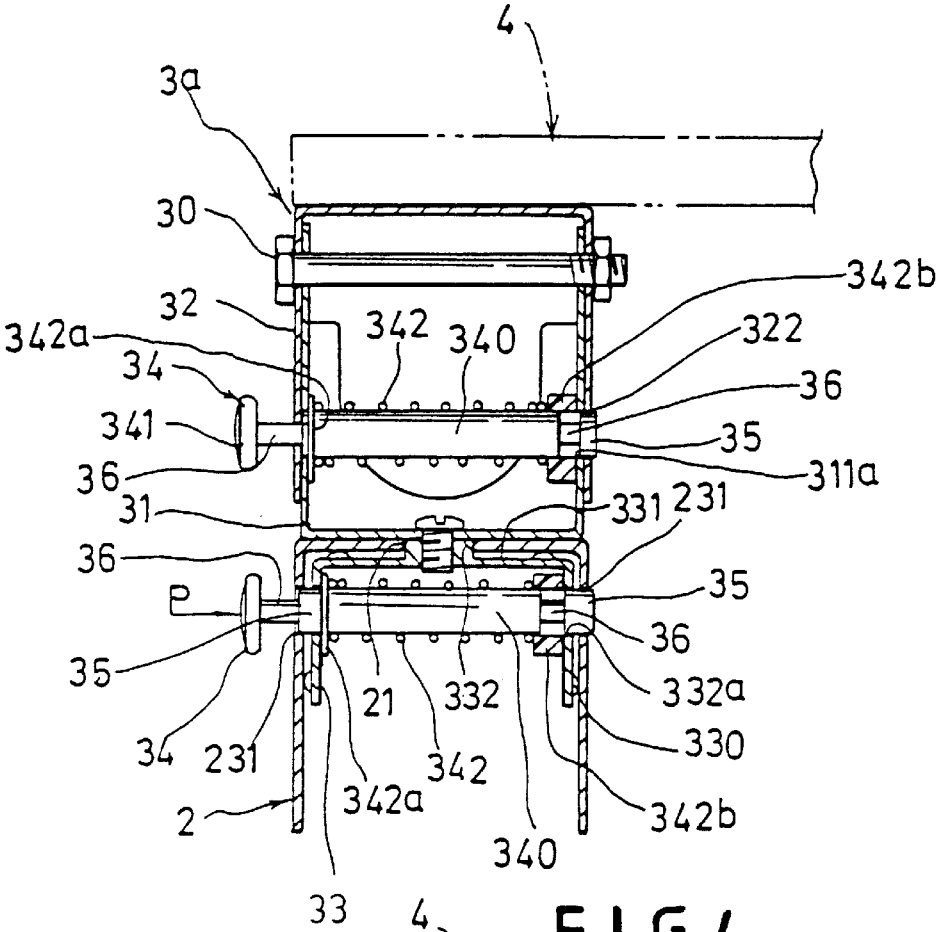
FIGS. 4 and 5 are sectional views illustrating the working principle of the positioning pin.
Figure 5:
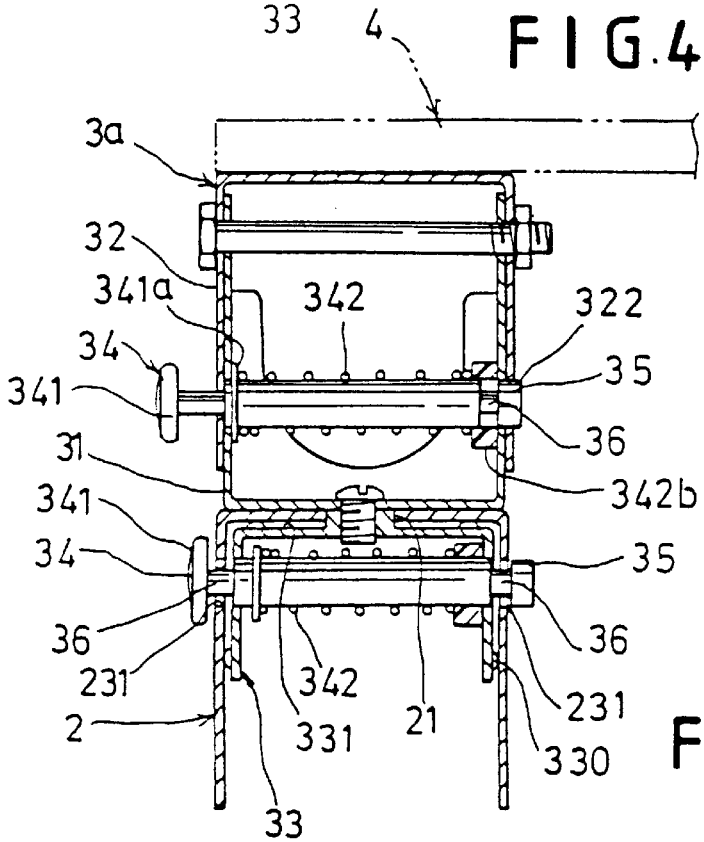

A second positioning pin 34 is inserted through the slots 23 of the receiving frame 2 and the holes 332*a* of the inverted U-shaped member 33. The position of the inverted U-shaped member 33 may be adjusted when the positioning pin 34 is depressed (see FIGS. 4 and 5).

In order to enable the first fixture 3*a* to be moved smoothly on the receiving frame 2, the inverted U-shaped member 33 is provided with a plurality of protuberances 330 thereon. Further, it should be noted that the bottom of the lower seat 31 may be provided with a plurality of protuberances (not shown) to facilitate the movement of the fixtures 3*a* and 3*b*.

When desired to adjust the distance between the two fixtures 3*a* and 3*b*, the positioning pin 34 connecting the receiving frame 2 to the inverted U-shaped member 33 is first depressed along the direction P (see FIGS. 4, 5 and 7) to separate the stopper 35 of the rod member 340 of the positioning pin 34 from the enlarged hole 231 of the slot 23 of the receiving frame 2 thereby enabling the fixture 3*a* to be adjusted in position, and then the hand wheel 371 is turned to rotate the lead screw 37 to adjust the position of the second fixture 3*b*.

Figure 6:
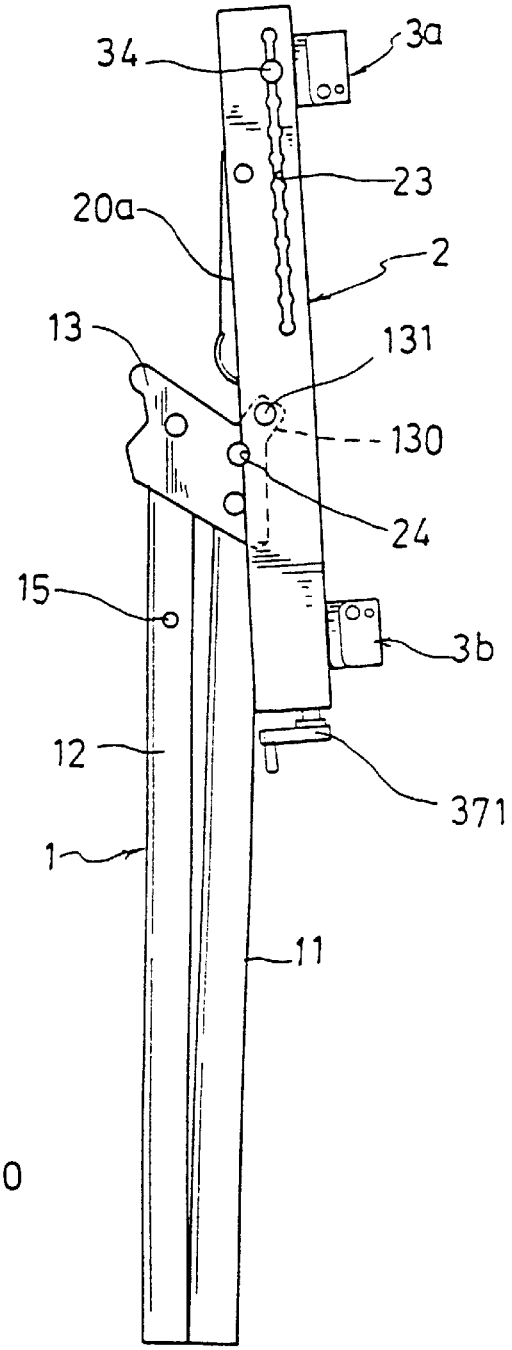
FIG. 6 illustrates the collapsed condition of the worktable.
Figure 6A:
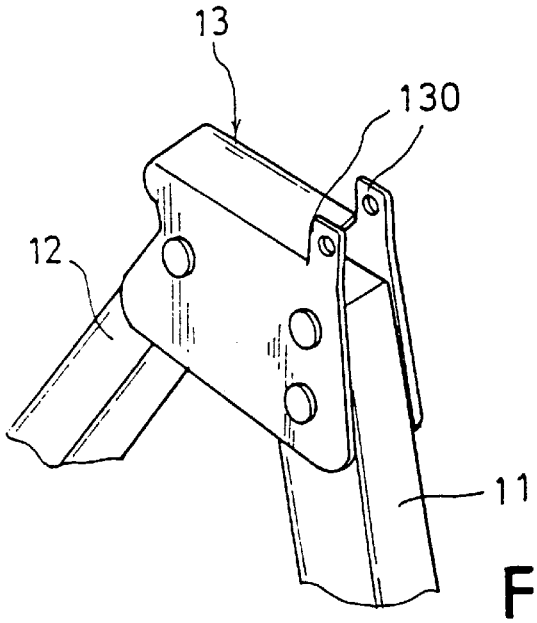
FIG. 6A is a perspective view of the joint member.

As shown in FIGS. 6 and 6A, the joint member 13 has a pair of lugs 130 at the top which are integral with the joint member 13 and are pivotally connected with the receiving frame 2 by a pin 131. In addition, the lower side of the receiving frame 2 is formed with a recess 24 for receiving the fixing bolt (shown but not numbered) of the joint member 13 (see FIG. 6).

The tabletop 4 may be a one-piece board or composed of a plurality of panels 40 each having a recess 41 at one side and a projection 41' at the other which are adapted to engage with the projection 41' and recess 41 of an adjacent panel 40.

The curved slot 312 at the bottom of the lower seat 31 is engaged with the raised portion 332 of the inverted U-shaped member 33 via a bolt and so the fixtures 3*a* and 3*b* can be rotated with respect to the receiving frame 2 to an angular position as required.

The invention is naturally not limited in any sense to the particular features specified in the foregoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A worktable comprising:

a pair of leg frames pivotally joined by a joint member;

a pair of receiving frames pivotally mounted on said joint member;

a pair of first fixtures each slidably mounted on each of said receiving frames; and a pair of second fixtures each slidably mounted on each of said receiving frames and drivingly connected with a lead screw fitted within each of said receiving frames;

each of said receiving frames having a top formed with a first longitudinal slot and a second longitudinal slot aligned with said first longitudinal slot and two opposite lateral sides each formed with a slot with spaced apart enlarged holes.

2. The worktable as claimed in claim 1, wherein each of said first fixtures includes a lower seat and an upper seat which is pivotally connected with said lower seat, and said second fixtures having same structure as said first fixtures except that said second fixtures each have a bottom provided with a block adapted to engage with said lead screw.

3. The worktable as claimed in claim 2, further comprising a first positioning pin connecting said lower seat to said upper seat, said first positioning pin including a rod member, said rod member having a first neck close to a first end thereof, a second neck close to a second end thereof, a button at said first end, and a stopper at said second end, a C-shaped retainer engaged with said rod member for keeping said rod member within said lower seat, and a packing ring, and a spring fitted over said rod member and arranged between said C-shaped retainer and said packing ring.

4. The worktable as claimed in claim 3, further comprising a second positioning pin connecting said inverted U-shaped member to said receiving frame, said second positioning pin being of same structure as said first positioning pin.

5. The worktable as claimed in claim 1, further comprising an inverted U-shaped member arranged within each of said receiving frames and having a top formed with a raised portion fitted into said first longitudinal slot of said receiving frame and connected to a bottom of one of said first fixtures.

6. The worktable as claimed in claim 5, wherein said lower seat has a bottom formed with a curved slot engaged with said raised portion of said inverted U-shaped member by a bolt.

7. The worktable as claimed in claim 1, wherein said joint member is formed with a pair of lugs pivotally connected with said receiving frame.

* * * * *